US005554083A

United States Patent [19]

Chen

[11] Patent Number: 5,554,083

[45] Date of Patent: Sep. 10, 1996

[54] MULTIPURPOSE EXERCISE MACHINE HAVING AN ARM DRILLING DEVICE

[76] Inventor: James Chen, No. 35, Tun Hi Rd., Chin Chan Li, Sa Lu, Taichung, Taiwan

[21] Appl. No.: 408,721

[22] Filed: Mar. 22, 1995

[51] Int. Cl.[6] ..... A63B 23/12

[52] U.S. Cl. ..... 482/95; 482/138

[58] Field of Search ..... 482/95, 96, 138

[56] References Cited

U.S. PATENT DOCUMENTS 5,201,694 4/1993 Zappel ..... 482/96 X 5,312,313 5/1994 Holmes et al. ..... 482/95

*Primary Examiner*—Richard J. Apley

*Assistant Examiner*—John Mulcahy

*Attorney, Agent, or Firm*—Browdy and Neimark

[57] ABSTRACT

A multipurpose exercise machine comprises an upright bar to which an arm drilling device is fastened. The arm drilling device is composed of a sliding seat and a support member. The sliding seat has a frame provided with a plurality of roller sets enabling the frame to move up and down along the upright bar. The support member comprises a support rod on which a leg support is mounted. The support rod is fastened at one end thereof with the frame. The support member is intended to provide both legs of an exerciser with a support when the exerciser is doing an arm building exercise.

1 Claim, 5 Drawing Sheets

MULTIPURPOSE EXERCISE MACHINE HAVING AN ARM DRILLING DEVICE

FIELD OF THE INVENTION

The present invention relates generally to an exercise machine, and more particularly to a multipurpose exercise machine provided with an arm drilling device.

BACKGROUND OF THE INVENTION

As shown in FIG. 1, a multipurpose exercise device 10 of the prior art comprises mainly a chest building mechanism 11, a lifting mechanism 13, and a pulling mechanism 15. Such a prior art exercise device 10 is often provided additionally with a horizontal bar or parallel bars for doing an arm exercise. However, such an added feature of the prior art exercise device 10 often fails to serve the purpose intended to attain.

SUMMARY OF THE INVENTION

It is therefore the primary objective of the present invention to provide a multipurpose exercise machine with an arm drilling device to facilitate an exerciser to do an arm building exercise in a progressive manner.

The foregoing objective of the present invention is attained by a multipurpose exercise machine comprising an upright bar to which an arm drilling device is fastened. The arm drilling device is composed of a sliding seat and a support member. The sliding seat has a frame provided with a plurality of rolling wheels enabling the frame to slide up and down along the upright bar. The support member comprises a support rod on which a leg support is mounted. The support rod is fastened at one end thereof with the frame. The support member is intended to provide both legs of an exerciser with a support when the exerciser is doing an arm building exercise.

The foregoing objective, features and functions of the present invention will be more readily understood upon a thoughtful deliberation of the following detailed description of the present invention in conjunction with the accompanying drawings.

DETAILED DESCRIPTION OF THE INVENTION

Figure 1:
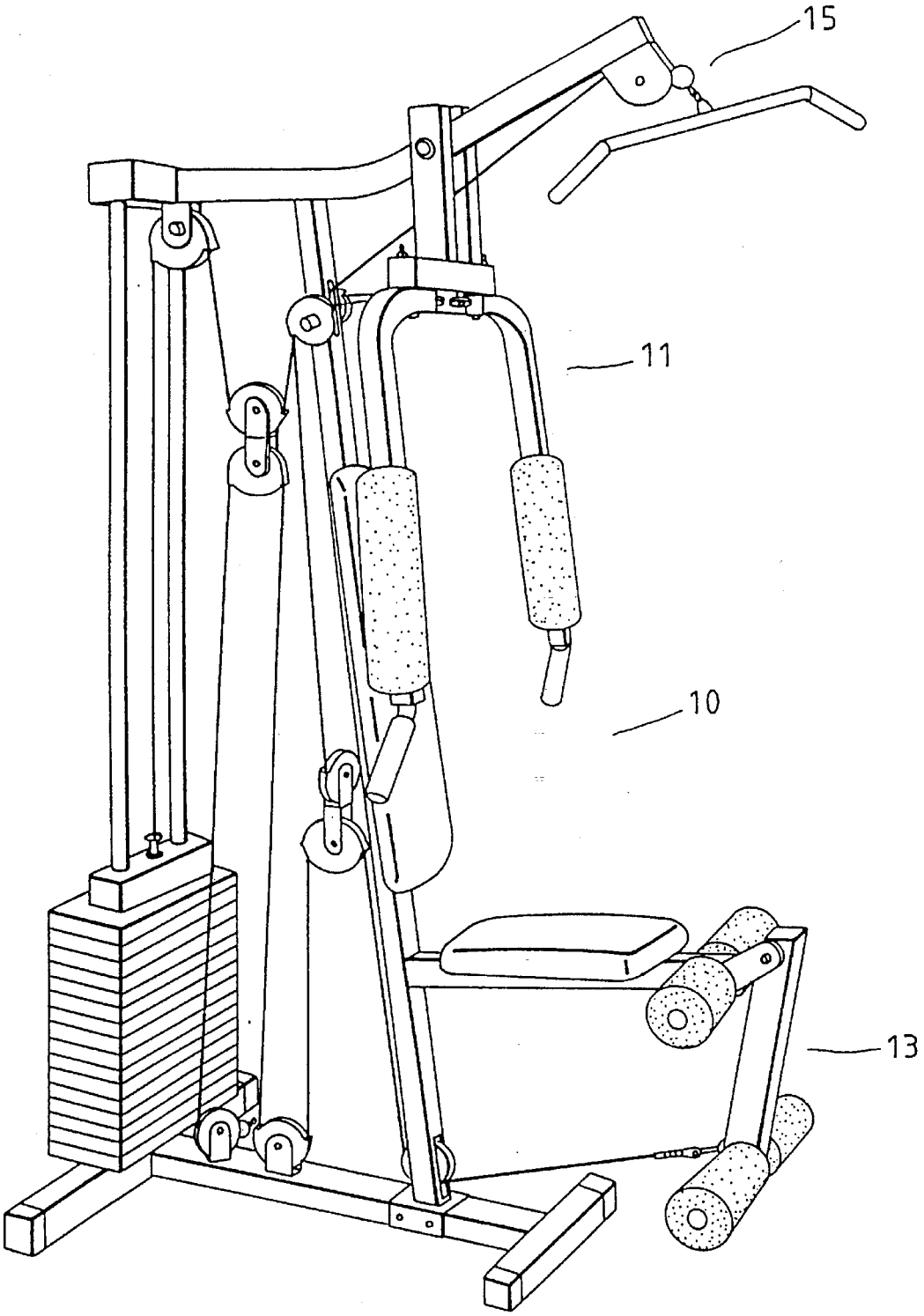
FIG.1 (PRIOR ART)
FIG. 1 shows a schematic view of a multipurpose exercise machine of the prior art.
Figure 2:
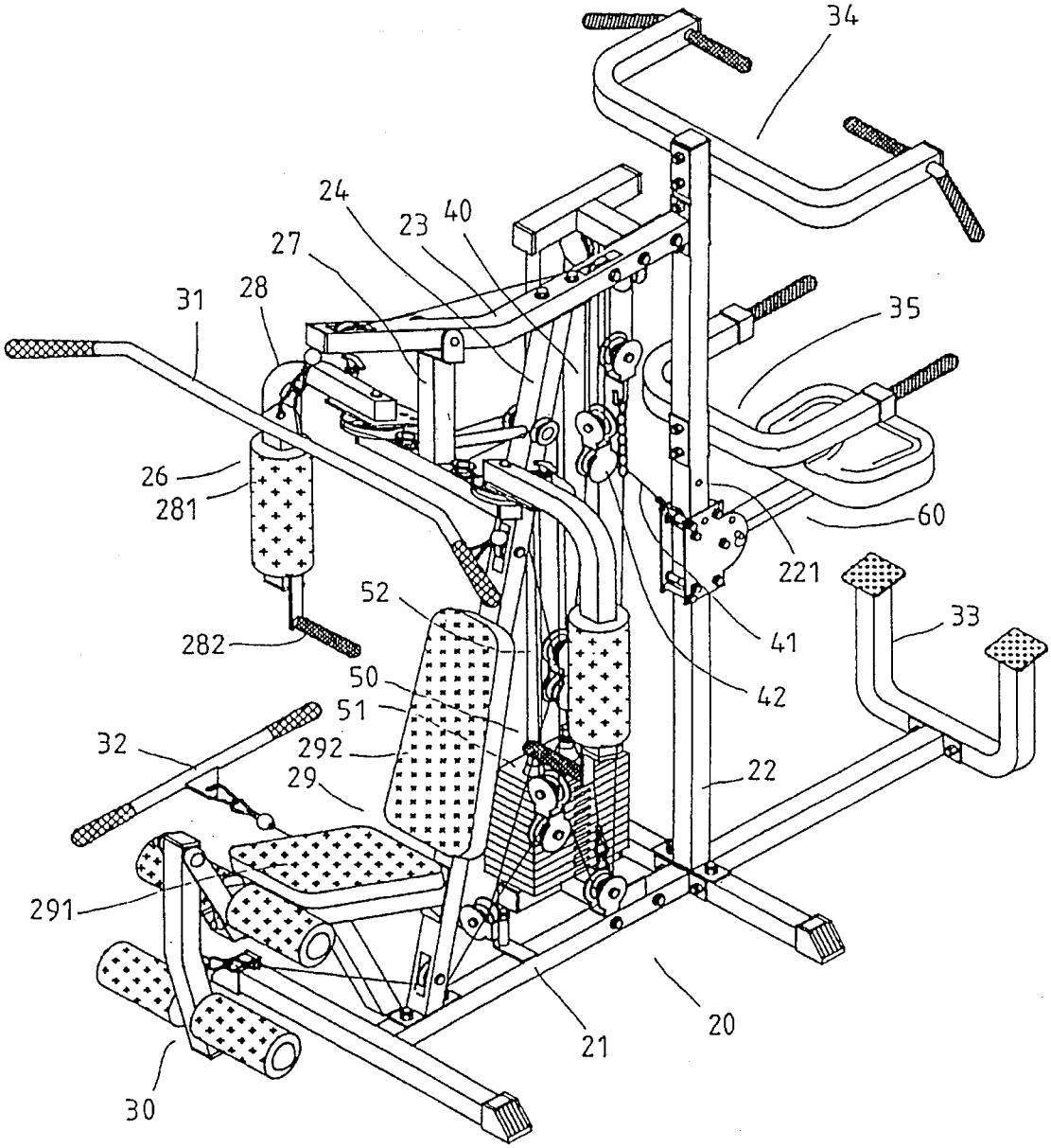
FIG. 2 shows a perspective view of a multipurpose exercise machine of the present invention.
Figure 3:
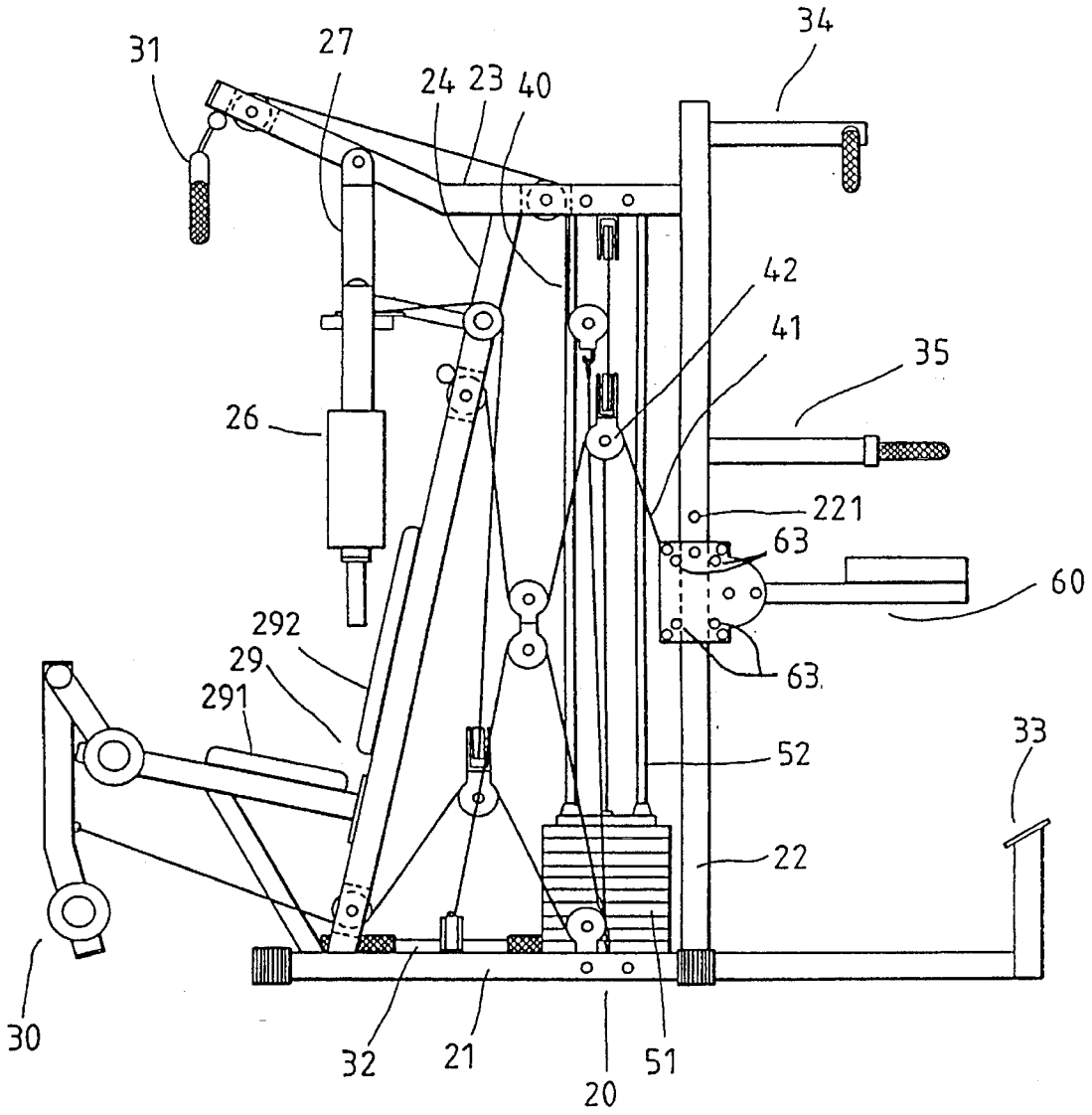
FIG. 3 shows a side view of the multipurpose exercise machine of the present invention.
Figure 4:
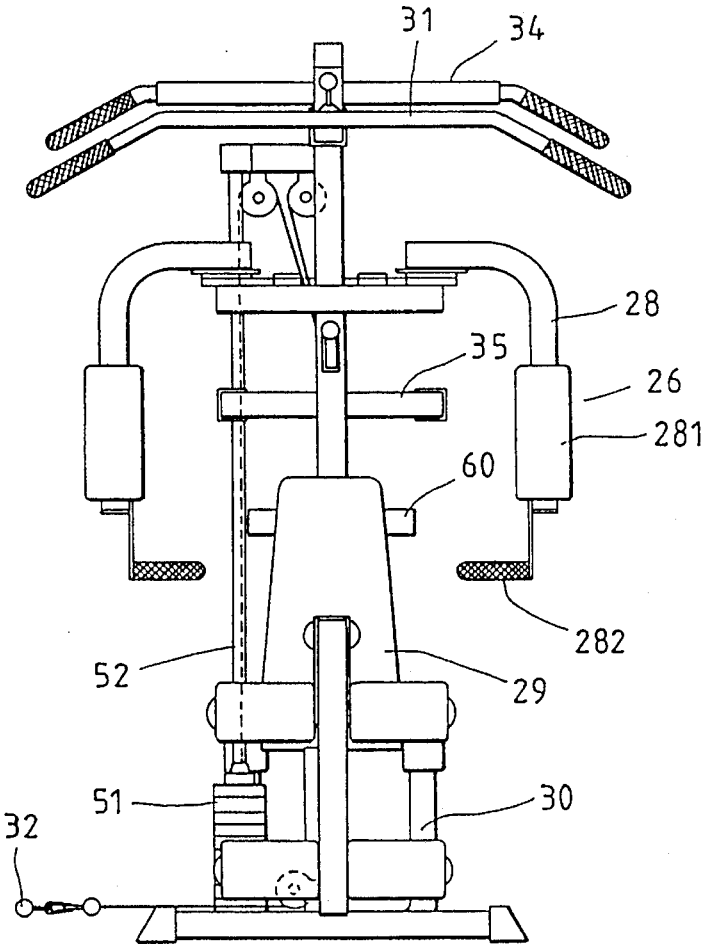
FIG. 4 shows another side view of the multipurpose exercise machine of the present invention.

As shown in FIGS. 2–5, a multipurpose exercise machine embodied in the present invention comprises a support frame 20, a pulley set 40, a weight-loading device 50, and an arm drilling device 60.

The support frame 20 comprises a bottom bar 21, an upright bar 22 extending upwardly from the center of the rear end of the bottom bar 21, an upper bar 23 extending obliquely from the upright bar 22, and a slanted bar 24 fastened at both ends thereof with the bottom bar 21 and the upper bar 23. A pushing and swiveling mechanism 26 is fastened with the upper bar 23 by means of a support rod 27. The pushing and swiveling mechanism 26 is provided respectively at both ends of the lower portion thereof with an arm 28, which is fastened pivotally at one end thereof with the support rod 27 and is provided with an elastic sleeve 281 and a hand grip 282. A seat 29 is fastened with the slanted bar 24 and is provided with a seat pad 291 and a backrest 292. A lifting mechanism 30 is disposed in front of the seat pad 291 and can be lifted by both legs of an exerciser sitting on the seat pad 291. An upper pulling member 31 is fastened with the upper bar 23 while a lower pulling member 32 is fastened with the bottom bar 21. Both pulling members 31 and 32 can be pulled by the exerciser. A treading support 33 is fastened to the rear end of the bottom bar 21. A horizontal bar support 34 is fastened with the top end of the upright bar 22. A parallel bar support 35 is fastened with the upright bar 22 such that the parallel bar support 35 is located under the horizontal bar support 34 and over the midpoint of the upright bar 22.

The pulley set 40 is disposed in a space surrounded by the bottom bar 21, the upright bar 22 and the upper bar 23. The pulley set 40 is composed of a pulrality of pulleys 42 which can be turned by a plurality of ropes 41 so as to transmit power. The ropes 41 are fastened respectively at one end thereof with various mechanisms and the pulling members of the present invention.

The weight loading device 50 comprises a plurality of weights 51 which are stacked together and can be lifted by one of the ropes 41 along two parallel shafts 52.

The arm drilling device 60 is fastened to the midsegment of the upright bar 22 such that the arm drilling device 60 is located under the parallel bar support 35. The arm drilling device 60 comprises a sliding seat 61 and a support member 70.

Figure 5:
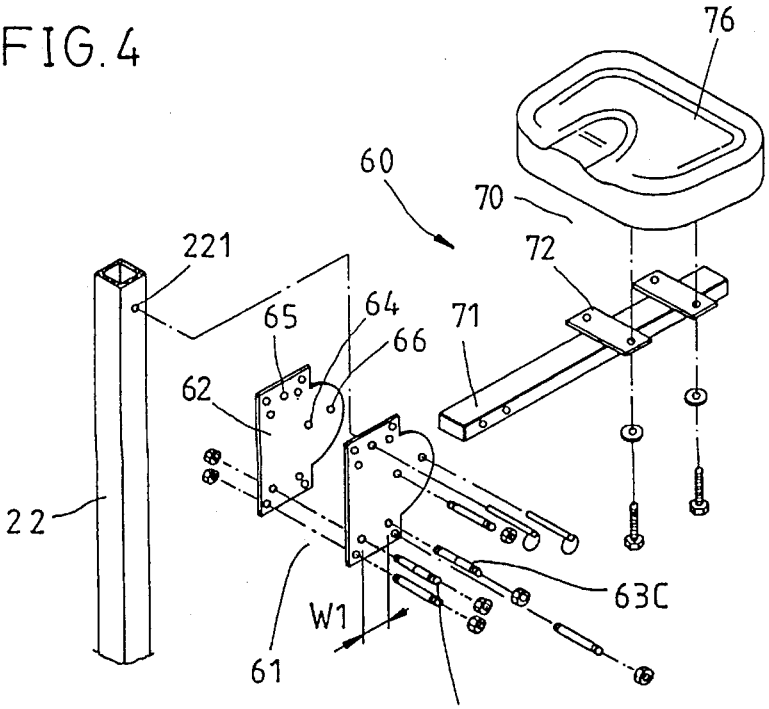
FIG. 5 shows an exploded view of an arm drilling device of the multipurpose exercise machine of the present invention.
Figure 6:
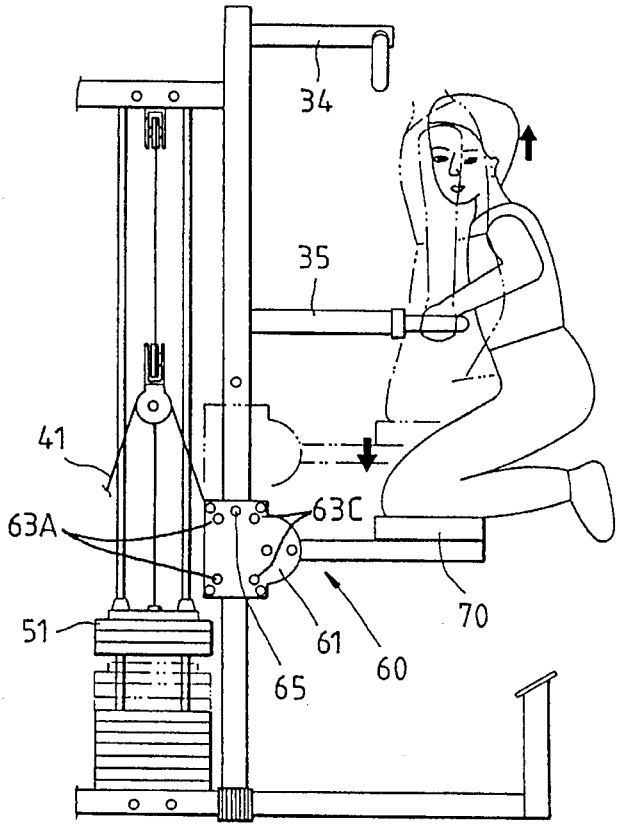
FIG. 6 is a schematic view showing that the arm drilling device of the multipurpose exercise machine of the present invention is used as parallel bars for doing an arm exercise.
Figure 7:
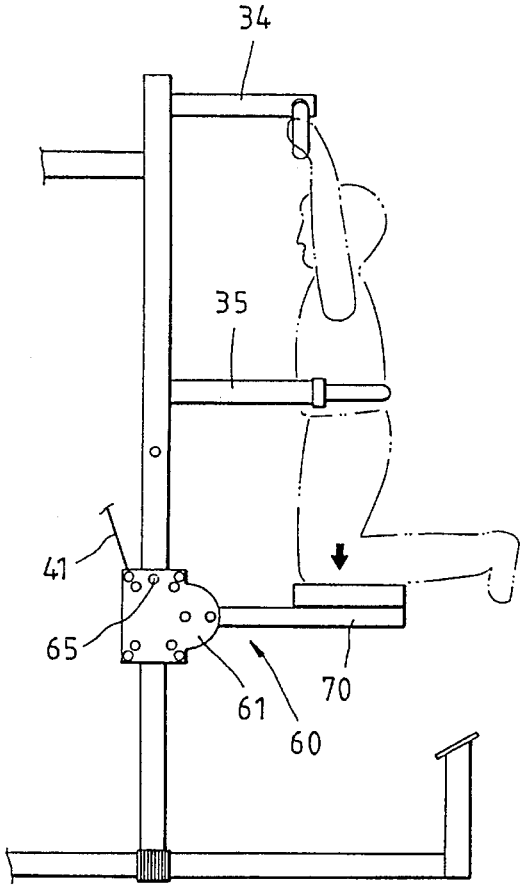
FIG. 7 is a schematic view showing that the arm drilling device of the multipurpose exercise machine of the present invention is used as horizontal bar for doing an arm exercise.

As shown in FIGS. 5, 6 and 7 sliding seat 61 is provided with a frame formed by two plates 62 which are fastened by means of a plurality of pins. The frame of the sliding seat 61 is provided with a plurality of roller sets 63, each of which is composed of a threaded rod, two shaft sleeves and a nut. The front and the rear roller sets are separated at a predetermined interval W1 which is equal to the width of the upright bar 22. The sliding seat 61 is mounted on the upright bar 22 such that the two roller sets 63A are in contact with the inner surface of the upright bar 22, and that the other two roller sets 63C are in contact with the outer surface of the upright bar 22. As a result, the sliding seat 61 can be caused to move up and down along the longitudinal axis of the upright bar 22. The plates 62 are provided respectively and centrally with a locating hole 64 and are further provided respectively with through holes 65 and 66, which are located respectively at the positions corresponding to 12 and 3 of the clock. The sliding seat 61 is located securely on the upright bar 22 by means of an insertion pin which is received in the through hole 65 and a horizontal hole 221 of the upright bar 22.

The support member 70 comprises a support rod 71 and a leg support 76. The support rod 71 is provided at one end thereof with a through hole dimensioned to receive therein an insertion pin. The support rod 71 is provided with another through hole via which an insertion pin can be disposed so as to enable the support rod 71 to swivel. The support rod 71 is further provided at another end thereof with two locking pieces 72 which are provided respectively with through holes in which bolts are received. The leg support 76 is mounted securely on the locking pieces 72 of the support rod 71.

As shown in FIG. 6, the insertion pin is removed from the through hole 65 of the sliding seat 61. As a result, the sliding seat 61 is pulled by the rope 41. When an exerciser, whose weight is 60 kg, desires to do a parallel bars exercise, he must first make sure that the weight of the weights 51 is 40 kg. As a result, the support member 70 is caused to slide downwards when the support member 70 is exerted on by the weight of the exerciser. As soon as the exertion force of the exerciser's arms is in excess of 20 kg, the support member 70 is pulled upwards. The weight of the weights 51 can be adjusted in accordance with the requirement of the exerciser.

As shown in FIG. 7, the arm drilling device 60 of the present invention can be used to do a horizontal bar exercise by an exerciser. When the arm drilling device 60 is used by the exerciser for doing the horizontal bar exercise, the operation of the sliding seat 61 is similar to the operation of the sliding seat 61 which is illustrated in FIG. 6.

When the multipurpose exercise machine of the present invention is used for doing exercises other than the arm exercises such as the horizontal bar and the parallel bars exercises, the insertion pin must be first inserted into the through hole 65 of the sliding seat 61 so as to fix securely the arm drilling device 60.

What is claimed is:

1. A multipurpose exercise machine comprising:

a support frame unit having a bottom bar, an upright bar extending upwardly from said bottom bar, an upper bar fastened to a top end of said upright bar, a slant bar fastened between said upper bar and said bottom bar;

a pushing and swiveling mechanism fastened with said upper bar;

a seat fastened to said slant bar;

a lifting mechanism located in front of said seat;

a pulling mechanism fastened with a front end of said upper bar;

a treading support mounted on said bottom bar;

a horizontal bar support fastened to an upper end of said upright bar;

a parallel bar support fastened to an upper portion of a midsegment of said upright bar;

a pulley set disposed in a space formed by said bottom bar, said upright bar and said upper bar, said pulley set comprising a plurality of pulleys and ropes;

a weight loading device provided with a plurality of weights and fastened with a first rope of said ropes; and an arm drilling device fastened to a midsegment of said upright bar such that said arm drilling device is located under said horizontal bar support and said parallel bar support, and that said arm drilling device is fastened with a second rode of said ropes of said pulley set;

wherein the weight loading device resists movement of the pushing and swiveling mechanism, the lifting mechanism, the pulling mechanism and biases the arm drilling mechanism upward;

wherein said arm drilling device comprises:

a sliding seat having a frame formed by two plates which are provided respectively with a plurality of roller sets capable of sliding on the surface of said upright bar so as to enable said sliding seat to slide up and down along said upright bar, said frame of said sliding seat provided centrally with a locating hole and further provided peripherally with at least one through hole; and a support member comprising a support rod and a leg support, said support rod provided at a front end thereof with a through hole which is coaxial with said locating hole of said frame of said sliding seat and is engageable with an insertion via which another insertion pin is inserted into said through hole pin, said support rod further provided with another through hole of said frame so as to enable said support rod to swivel, said leg support mounted on said support rod for supporting thereon both legs of an exerciser;

wherein said upright bar is provided in a midsegment thereof with a horizontal hole Which is coaxial with a through hole located at a top of said frame of said sliding seat and is engageable with an insertion pin for locating said sliding seat on said upright bar.

* * * * *